United States Patent [19]

Bencriscutto

[11] Patent Number: 4,795,157

[45] Date of Patent: Jan. 3, 1989

[54] GOLF CLUB PUTTER

[76] Inventor: Michael Bencriscutto, 6121 Golf Ridge Dr., Racine, Wis. 53402

[21] Appl. No.: 945,010

[22] Filed: Dec. 22, 1986

[51] Int. Cl.[4] ..... A63B 69/36; A63B 53/04

[52] U.S. Cl. ..... 273/164; 273/169; 273/80 A

[58] Field of Search ..... 273/163 R, 167 B, 162 R, 273/164, 183 D, 167 C, 162 B, 80 A, 169; D21/218, 219

[56] References Cited

U.S. PATENT DOCUMENTS

| | | | |
|---|---|---|---|
| D. 228,513 | 10/1973 | Brower | 273/164 |
| 1,064,916 | 6/1913 | Kelly et al. | 273/169 |
| 1,485,272 | 2/1924 | Kinsman | 273/164 |
| 1,617,090 | 2/1927 | Worthington | 273/169 |
| 2,859,972 | 11/1958 | Reach | 273/164 |
| 3,680,860 | 8/1972 | Elkins | 273/183 D |
| 3,888,484 | 6/1975 | Zitko | 273/164 |
| 3,979,125 | 9/1976 | Lanrellotti | 273/163 R |
| 4,082,286 | 4/1978 | La Breche | 273/183 D |
| 4,174,839 | 11/1979 | Marrs | 273/183 D |

FOREIGN PATENT DOCUMENTS

| | | | |
|---|---|---|---|
| 7550 | of 1900 | United Kingdom | 273/167 B |

*Primary Examiner*—George J. Marlo

*Attorney, Agent, or Firm*—James E. Nilles; Donald C. McGaughey

[57] ABSTRACT

A golf club putter with an aid for putting on an inclined green includes a head presenting a longitudinally extending top surface visible to the golfer when in use with the surface having ball position striking markers spaced apart longitudinally from each other. The markers include: a first curved line identifying one ball striking location adjacent the club handle which curves inwardly toward the golfer to indicate to the golfer that the ball, when struck at the one location, will curve in the direction shown by the first curved line; and a second curved line on the top surface located adjacent the outer end of the putter head longitudinally spaced from the first curve and curving outwardly away from the golfer to identify another ball striking location to indicate to the golfer that the ball, when struck at the other ball striking location, will curve in the direction shown by the second curved line.

1 Claim, 3 Drawing Sheets

CLUB FACE CF1
OPEN ON IMPACT WITH BALL

CLUB FACE CF
CLOSED ON IMPACT WITH BALL

CLUB FACE CF1
OPEN ON IMPACT WITH BALL

CLUB FACE CF
CLOSED ON IMPACT WITH BALL

GOLF CLUB PUTTER

BACKGROUND OF THE INVENTION

Many prior art golf clubs have been proposed and which have certain markings at various locations thereon to aid the golfer in properly striking the golf ball. However, none of these prior art devices provide the golfer with markers that instinctively tell the golfer where to address the ball on the club face in order to cause the ball to follow the desired curve path on an inclined green. Furthermore, various prior art golf clubs and particularly putters, have been used with various weights built into the club head for various reasons. However, none of these prior art devices provide a golf club having a head that is weighted in in such a manner as to cause the ball to adhere to the green rather than hopping or jumping up when hit.

SUMMARY OF THE PRESENT INVENTION

The present invention provides a golf club putter having a head with a top surface that is visible to the golfer when in use, and ball positioning markers on the top surface of the club head for indicating to the golfer where on the club face where the ball is to be hit, depending on the lie of the green. A more specific aspect of the present invention provides such a golf club wherein a marker is provided on the club head to indicate where the ball should be hit if the lie of the green is from left to right as viewed by the golfer, and another marker is provided on the club head to indicate where the ball should be struck if the lie of the green is in the direction from right to left as viewed by the golfer.

A more limited aspect of the present invention relates to a golf club of the above type in which the head has a majority of its weight and its center of gravity located in the upper half thereof, whereby when the golf ball is struck by the head, it will tend to hug the green, that is it will remain on the green and follow its contour and not hop or rise off of the green.

DESCRIPTION OF THE PREFERRED EMBODIMENT

The Markers

Figure 6:
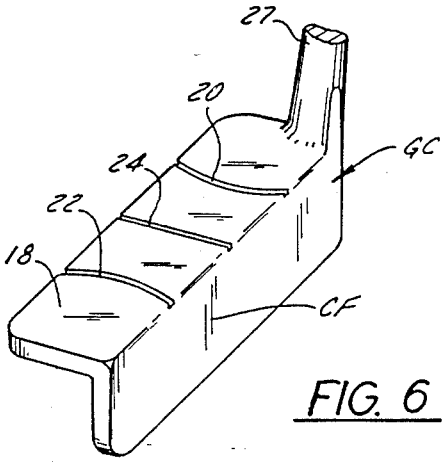
FIG. 6 is a perspective view of the club head.

The golf club GC provided by the present invention has markings on its longitudinally extending top surface 18 and which are clearly visible to the golfer when using the club. These markings include the marking 20 which is located adjacent the heel of the club. Marker 20 curves to the left or inwardly of the club head adjacent the face CF of the club. A straight marker 24 is located generally centrally of the club and extends straight across in a transverse direction of the club head. The marker 22 is located at the toe area of the club, i.e., generally towards the outer end of the club. The curved marker 22 curves outwardly of the club or to the right away from the club handle 27 at the area adjacent the club face CF. As clearly shown in FIGS. 2, 4 and 6, first and second curves 20, 22 are longitudinally spaced apart and unconnected with each other with straight marker 24 spaced equidistant between the markers 20 and 22.

Figure 2:
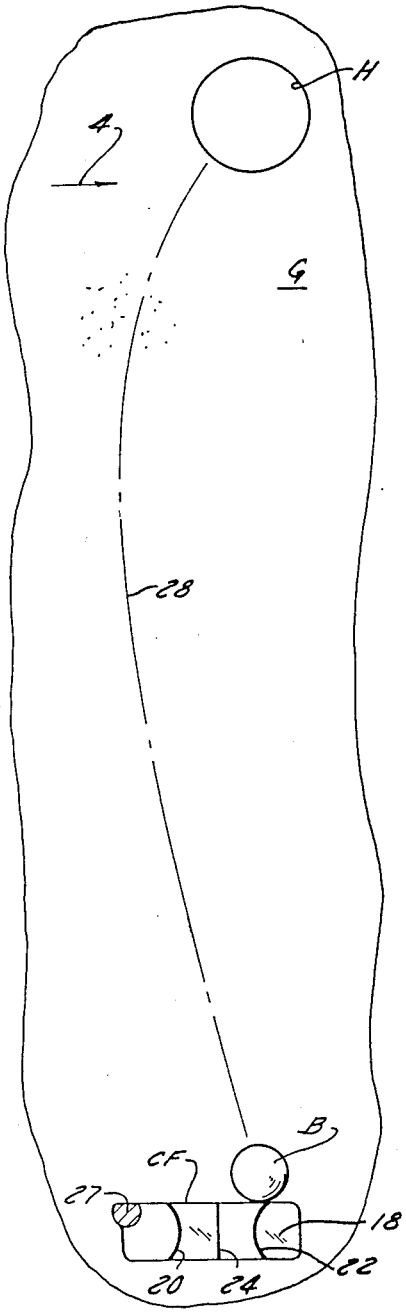
FIG. 2 is a plan view of the green shown in FIG. 1 and showing the hole H and the pitch being indicated by the arrow 4, that is from left to right, the figure also showing a plan view of the golf club made in accordance with the present invention.

The plan view of FIG. 2 shows where the golf ball B would be struck by the club, namely on the toe or outer end of the golf face and at the location marked by the curve 22 which curves to the right adjacent to the club face CF.

Figure 8:
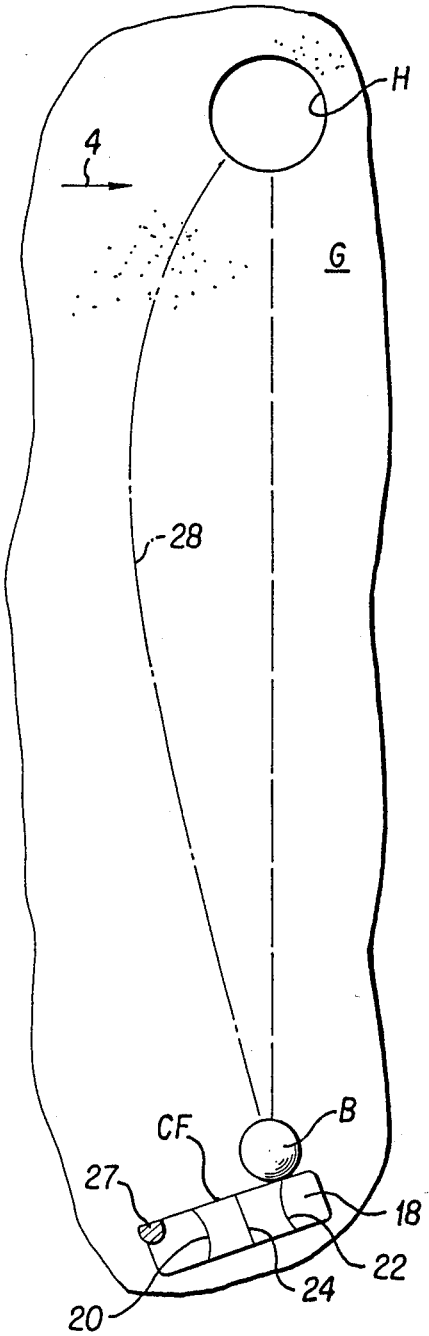

Thus, in putting the ball B on the green G that slopes downward to the right as when viewed by the golfer, the ball B would be hit by the outer end of the club face, that is the end away from the handle 27 and at the area marked by the marker curve 22. When the ball is hit at this area of the club face, the natural tendency of the golfer is to cause the ball to travel to the left, as shown in FIG. 8, that is to the uphill side of the hole, and generally along the intended path as shown by the broken line 28. Thus, the golfer automatically causes the ball to travel to the upside of the hole when the ball is hit in the toe area of the club face marked by the marker curve 22.

Stated otherwise, when the ball is hit on the club toe, the golfer instinctively hits the ball to the left by the club face closing on impact.

Figure 3:
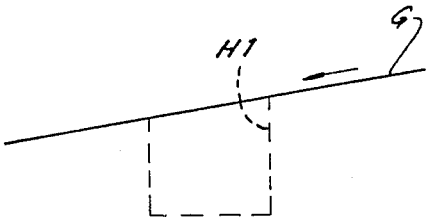
FIG. 3 is an elevational view, in section, of a green showing the pitch of the green as being from right to left as indicated by the arrow when viewed by the golfer.
Figure 1:
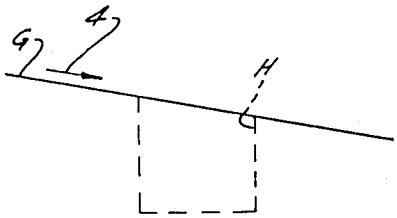
FIG. 1 is a sectional, elevational view of a golf green and showing the pitch of the green G as being from left to right when viewed from the golfer, and as indicated by the arrow in FIG. 1.
Figure 4:
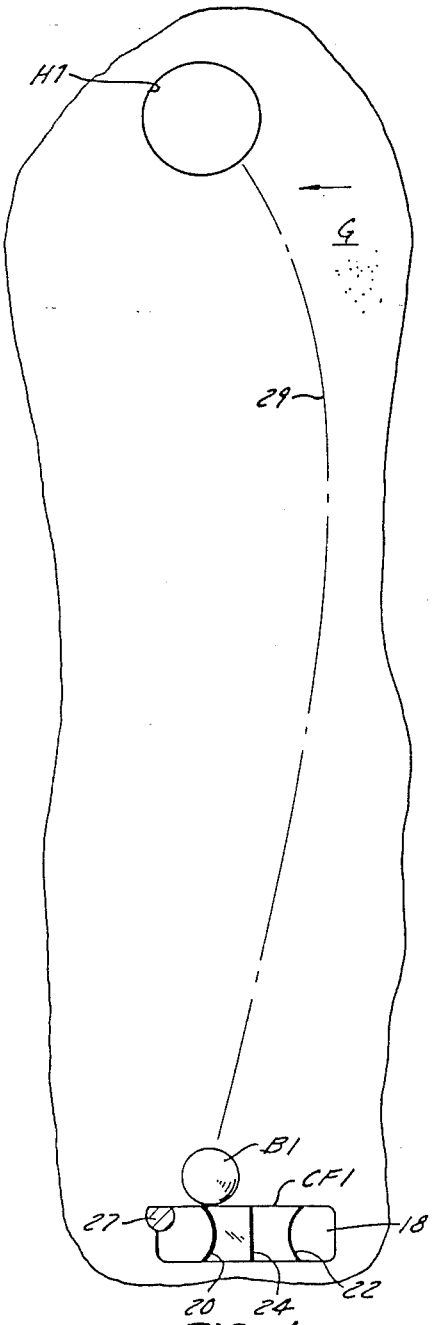
FIG. 4 is a plan view of the green shown in FIG. 3, the view also showing the plan view of the club of the present invention.
Figure 7:
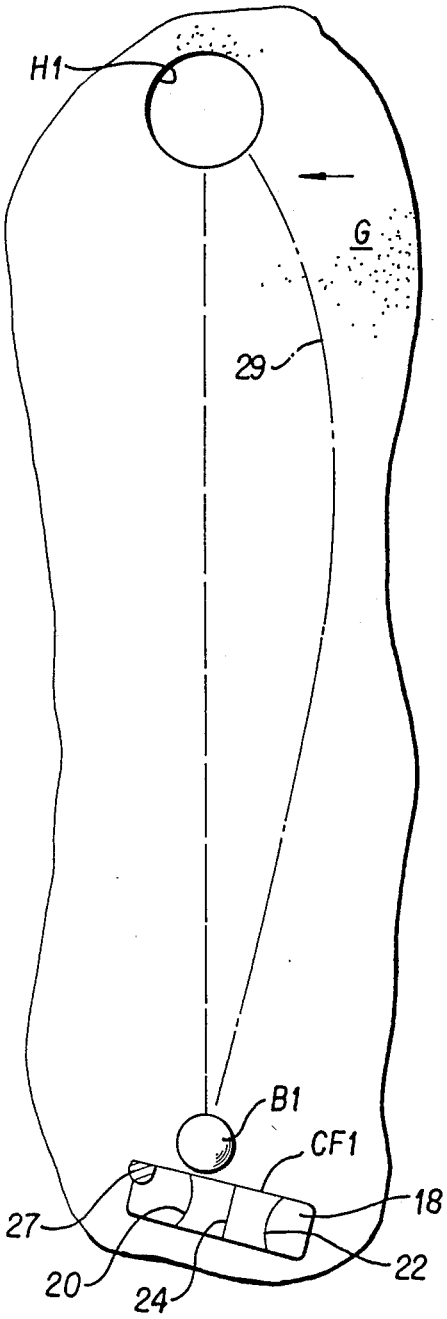
FIGS. 7 and 8 show the club head in "open" and "closed" positions, respectively.

On the other hand as shown in FIG. 4, when the lie of the green is to the left, that is, sloping downwardly to the left as viewed by the golfer, the ball would be hit by the heel or inner end of the club at the area marked by the curve 20 on the top of the club head. Striking the ball at that location of the club head causes the ball to first travel to the right, as shown in FIG. 7, that is toward the uphill side of the hole H1, as indicated by the intended curved path of travel 29, and hopefully into the hole H1.

Stated otherwise, when the ball is hit on the club heel, the golfer will not close the club face at impact and therefore the ball will stay above the hole as shown in FIG. 4.

By having the markers 20 and 22 of curves such as shown in the drawings, and described above, the golfer is advised of the direction of the curve of the path of the ball when the ball is struck in the particular area of the club designated. In other words, when the golfer hits the ball at the marker 20, he will instantly be aware that his ball will curve in the direction shown by the curve 20. Similarly, marker 22 indicates to the golfer the direction of the intended curved path of the ball if the ball is struck at the marker curve 22.

Club Weight

Figure 5:
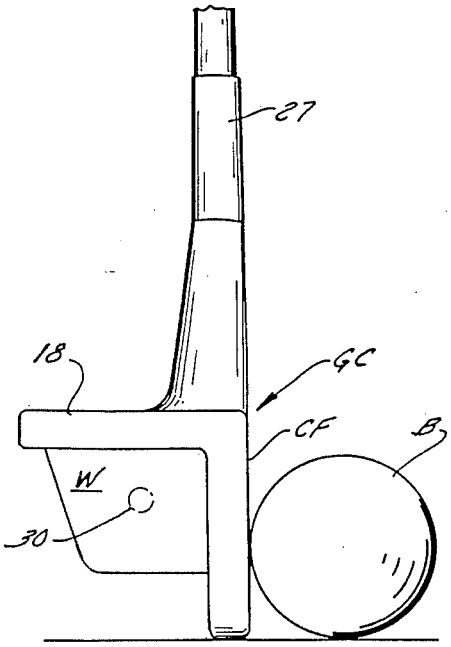
FIG. 5 is a vertical, transverse cross-sectional view through the club head.

As shown in FIG. 5, the majority of the weight W of the club GC is generally located directly behind the upper side of the club face, that is the center of gravity 30 of the club is located behind the upper area of the club face. Thus, the majority of the weight and the center of gravity of the club head are located in the upper half of the club head. By so weighting the club head, the ball when struck, will not be raised off the green, but instead will travel smoothly along the green and without hopping or jumping up from the green.

The golf club putter provided by the present invention has the combination markers above described together with a weighted club having its center of gravity in the upper half of the club head, thereby causing the ball when struck by the club to curve in the desired direction on the green and at the same time stay firmly down on the green.

What is claimed as the invention is:

1. A golf club putter having means for aiding a golfer to putt a golf ball on an inclined green where the point of aim for the path of travel of the golf ball must be toward the uphill side of the hole, said putter including a head having a longitudinally extending top surface visible to the golfer when in use, a ball contacting face generally vertical when in use, an inner end and an outer end and a handle extending upwardly from said inner end of said head wherein the improvement comprises:

ball position striking markers spaced apart longitudinally from each other on said top surface of the club for indicating to the golfer where on said face the ball is to be hit depending on whether the uphill side of said green is to the right or left of the hole relative to said golfer when in a putting position at said ball;

said markers including a first curved line on said top surface identifying one ball striking location adjacent said club handle at said inner end of said head including opposite ends which curve inwardly toward said inner end and toward the golfer to indicate to the golfer that the ball, when struck at said one location, will travel either toward a right target point the golfer has selected to aim at on said right uphill side of said hole and curve in the direction shown by said first curved line or, another point on said right uphill side of said green that is even slightly more uphill of said right target point if the golfer instinctively opens the face of said club on impact to increase the possibility that said golf ball will not follow a path of travel on said right uphill side that will take said ball below said hole;

said markers also including a second curved line on said top surface located adjacent said outer end of said head including opposite ends which curve outwardly toward said outer end and away from the golfer, said second curved line being longitudinally spaced from said first curved line and identifying another ball striking location to indicate to the golfer that the ball, when struck at said another ball striking location, will either travel toward a left target point the golfer has selected to aim at on said left uphill side of said hole and curve in the direction shown by said second curved line, or another point on said left uphill side of said green that is even slightly more uphill than said left target point if the golfer instinctively closes the face of said club on impact to increase the possibility that said golf ball will not follow a path of travel on said left uphill side that will take said ball below said hole.

* * * * *